United States Patent [19]

Hartmann et al.

[11] Patent Number: 4,753,698

[45] Date of Patent: Jun. 28, 1988

[54] METHOD FOR THE PRODUCTION OF SPUN BONDED NONWOVEN FABRICS HAVING A UNIFORM STRUCTURE

[75] Inventors: Ludwig Hartmann, Weinheim; Gerhard Müller, Kaiserslautern, both of Fed. Rep. of Germany

[73] Assignee: Firma Carl Freudenberg, Weinheim, Fed. Rep. of Germany

[21] Appl. No.: 919,849

[22] Filed: Oct. 16, 1986

[30] Foreign Application Priority Data

Dec. 3, 1985 [DE] Fed. Rep. of Germany ..... 3542660

[51] Int. Cl.[4] ..... D04H 3/16

[52] U.S. Cl. ..... 156/167; 156/181; 19/299

[58] Field of Search ..... 156/167, 181; 19/299; 264/518, 211.12, 211.14

[56] References Cited

U.S. PATENT DOCUMENTS

| | | | |
|---|---|---|---|
| 3,293,718 | 12/1966 | Sheets | 19/299 |
| 3,563,838 | 2/1971 | Edwards | 156/181 |
| 3,692,618 | 9/1972 | Dorschner et al. | 156/167 |
| 3,991,250 | 11/1976 | Hartmann et al. | 156/167 |
| 4,217,159 | 8/1980 | Ellis et al. | 156/181 |
| 4,578,134 | 3/1986 | Hartmann | 156/167 |

FOREIGN PATENT DOCUMENTS

| | | |
|---|---|---|
| 1510245 | 1/1970 | Fed. Rep. of Germany . |
| 1560790 | 2/1971 | Fed. Rep. of Germany . |
| 1303569 | 8/1974 | Fed. Rep. of Germany . |

*Primary Examiner*—Jerome Massie
*Assistant Examiner*—D. Herb
*Attorney, Agent, or Firm*—Felfe & Lynch

[57] ABSTRACT

Disclosed is a method for producing spun bonded nonwoven fabrics which have a highly uniform fleece structure and a uniform weight per unit area. In the method, a plurality of linear ranks of filaments, disposed side by side are spun from a plurality of long spinnerets. The filaments are aerodynamically drawn downward, stretched, and then fixed on a moving screen. The linear ranks of filaments are deflected and set in a pendular movement. The ranks are carried on an air cushion on the moving screen through a spreading section in which the ranks of filaments are turned around and laid down in a criss-crossing and substantially loop-like manner, and are fixed on the screen by vacuum.

14 Claims, 1 Drawing Sheet

A
B
C
D
E
F
G
H
α

METHOD FOR THE PRODUCTION OF SPUN BONDED NONWOVEN FABRICS HAVING A UNIFORM STRUCTURE

BACKGROUND OF THE INVENTION

The present invention is in a method for the production of spun bonded nonwoven fabrics with improved uniformity of fleece structure and of weight per unit area distribution. The improved fleece is produced by spinning linear filament ranks disposed parallel side by side from a plurality of long spinnerets, subjecting the ranks to air jets downdraft and stretching the filaments or filament ranks by means of air streams. The spun bonded nonwoven fabric is then fixed on a moving screen.

The production of spun bonded nonwoven fabrics by mechanical or aerodynamic drawing and stretching of filaments or of filaments arrayed in ranks is known. The spun bonded nonwoven fabrics is deposited in a random structure on a moving screen and delivered in this form to a consolidating unit. When the air streams strike against the perforated conveyor belt a slight turbulence is produced during the formation of the fleece, which conflicts with and impairs the uniformity with which the fleece is laid down. It is known that the uniformity of spun bonded nonwoven fabrics can be improved especially in the case of a large number of filaments, if the filaments are spun out of long spinnerets (DE-AS No. 13 03 569). In the aerodynamic stretching of the relatively loosely guided filaments, however, there is the danger of turbulence here, too. This turbulence becomes undesirably manifest when the production of spun bonded nonwoven fabrics of low weight and high uniformity is involved.

An object of the present invention is to produce spun bonded nonwoven fabrics having a high uniformity of fleece structure and weight per unit area distribution in a manner which can be performed on a large technical scale while avoiding turbulence in the laying of the fleece. At the same time, for the reasons given above, long spinnerets are to be used, and the filament ranks disposed parallel and side by side are to be drawn and stretched aerodynamically into air jets. In the fleece-forming zone the filaments are not to become entangled on the moving screen and must not develop undesired striation and crimping. It is desirable that the method be suitable especially for large technical scale equipment processing several thousands of filaments and producing fleeces in widths of over 5 meters.

SUMMARY OF THE INVENTION

In the method of the present invention spun bonded nonwoven fabrics are produced which have improved uniformity of the fleece structure and area weight distribution. The fleeces of the invention are produced by spinning linear filament ranks disposed parallel side by side from a plurality of long spinnerets. The ranks are then subjected to an aerodynamic downdraft and stretching of the filaments or filament ranks by means of air streams. The spun bonded nonwoven fabric is then fixed on a moving screen.

In the invention, the linear filament ranks are set in a pendular movement below the air jet channel by deflecting the air stream by means of parallelly disposed, movable Coanda rolls. After passing through a free-flight distance in which the filaments touch one another, the ranks are laid down on the screen in the fleece-forming zone such that they pass through a spreading section which moves back and forth at an angle of 30° to 40° to the direction of fleece movement, while the linear filament ranks are deflected by 45° to 90° within the spreading section and are deposited crossing one another and in a substantially arcuate manner, and are fixed thereon by the aspiration of the air through the screen.

The present invention overcomes the prior art disadvantages and makes it possible to deposit a very large number of filaments, e.g., more than 30,000 filaments over the desired width of more than 5 meters, to form a coherent, uniform fleece having a uniform distribution of weight per unit area.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figures 1, 2, 3, 4:
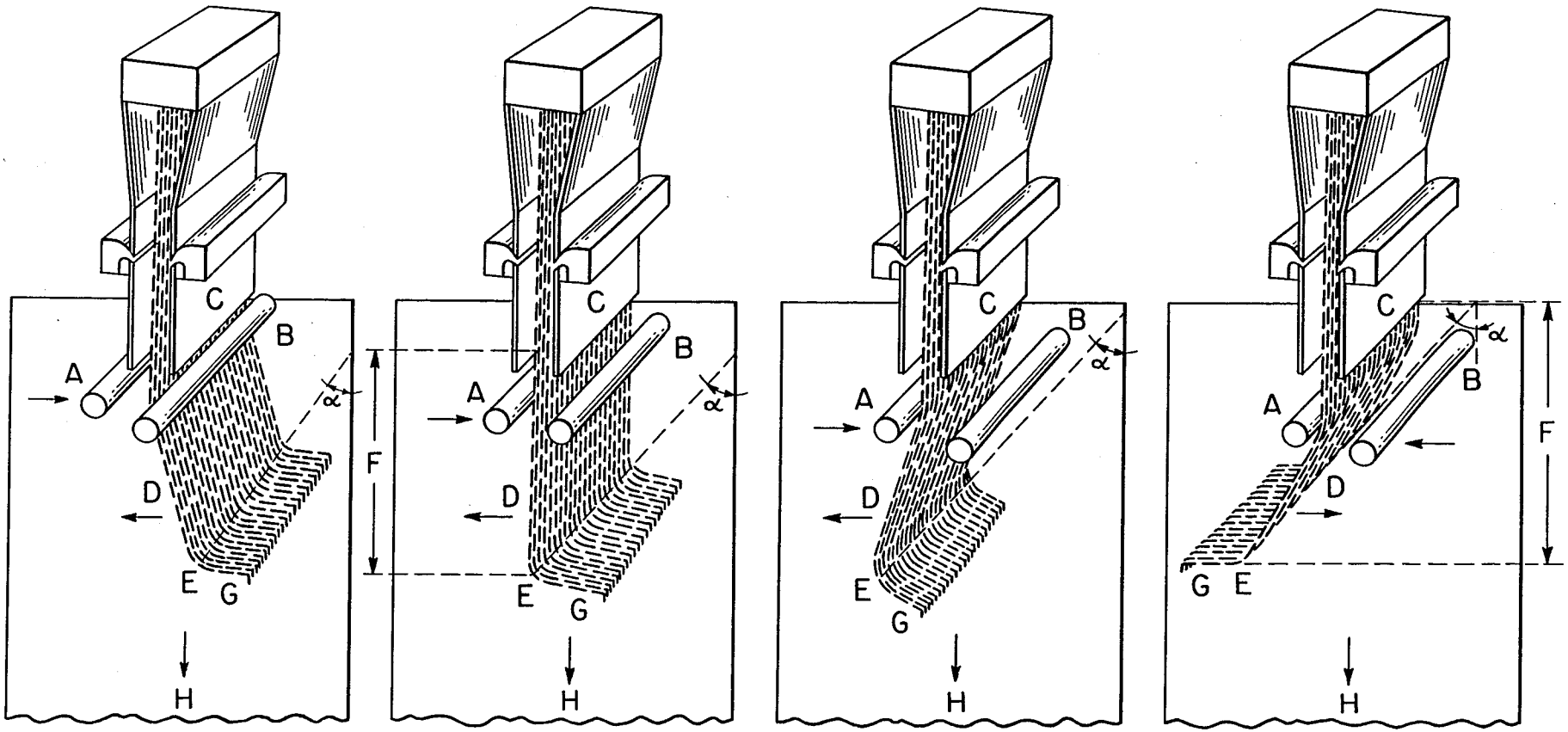
FIGS. 1 to 4 each show an isometric view of a stage of the process while the screen H is shown in plan view.

In the practice of the invention, a plurality of long spinnerets are situated on a spinning beam transversely across the laying or fleece-forming zone at a distance of 150 to 400 mm. Usually 15 to 30, but also more than 30, spinnerets are disposed parallel side by side, each spinneret spinning between 600 and 1200 filaments arrayed in a straight line or rank.

Important properties of the filaments are developed from the spinneret exit through the air jets or cooling shafts. The filaments, leaving the spinneret in the molten state, are molecularly oriented by aerodynamic stretching. This orientation is "frozen" by controlled cooling. According to the type of polymer, a post-crystallization follows at a later point in time.

It is known that the fiber properties produced or induced in the stretching and cooling zone, which are determined largely by the chemical and physical structure of the filaments, are important for the properties of spun bonded nonwoven fabrics.

The mutual arrangement of the filaments, which takes place in the fleece-forming zone is also important. The configuration of the fleece-forming zone is of decisive importance for the properties of the fleece that is to be formed from many thousands of filaments especially in the case of large production machinery with a great number of spinnerets and air jets passages, with the necessary production width of 4 to 5 meters and more.

As such, the configuration of the fleece forming zone is important in the method proposed according to the invention. The flowing delivery of the ranks of filaments through the oscillating zone and their soft flowing and smooth deposit on the screen results in an optimum uniformity of the fleece structure. The filaments or the linear filament ranks are deflected within the oscillating zone by 45° to 90° and laid down across one another in a substantially looping manner.

After the individual linear rank of filaments consisting of several hundreds of parallel single filaments leaves the stretching passage associated with it, the filaments and the airstreams carrying them are made to perform an osciallating movement by means of Coanda rollers disposed on both sides of each rank. The filaments thus are made to swing to and fro and are guided in this rhythmical swinging movement transversely or at a transverse angle to the advancing screen on which they are laid down. At the same time the filaments of each rank are carried into the area where the filaments of the adjacent rank are laid down, such that a coherent, wide fleece, that can be more than 5 meters wide, is produced. The oscillating movement of the filament ranks transversely of the belt on which they are deposited can cause pile-ups at the reversal points, because the swinging velocity at the reversal point is zero, yet the rate of arrival of the filaments from the spinneret remains the same. This can lead to irregularities. This problem can be solved by adapting the spinning conditions accordingly. The maintenance of a spinning velocity (filament velocity) of 20 to 100 meters per second, a downdraft air velocity of 40 to 200 meters per second, and a free-flight distance before the filaments are laid down of 500 to 1500 mm, has proven practical, while at the same time a filament spread of 100 to 200 mm is to be maintained and the spreading distance in the area of the filament deflection of a spinning line wanders by 100 to 1500 mm. These spinning conditions relate to fleeces of over 5 meters in width and are adaptable to the particular width of the fleece that is desired.

After they leave the airjets the filaments and linear ranks of filaments pass through a free-flight path and a spreading path in which they touch one another and strike against the moving screen, but to some extent fly up again and drop back down again and rearrange themselves in a substantially looping manner. It is important that the undesirable pile-ups caused at the points of reversal by the pendular movement of the filament ranks and filaments be evened out. The fleece-forming or spreading zone is therefore very important. The free-flight and spreading section is configured such that both the width of the rank of filaments in the free-flight section and the length of the free-flight section can be adjusted, the width of the filament rank upon reaching the screen being brought into a relationship to the distance between adjacent ranks of filaments. The width of the rank of filaments immediately after spinning differs from the width of the same rank in the area of the fleece-forming zone. In the spreading section, whose configuration is controlled through the intensity of the downdraft through the screen, the desired movement of the filaments is achieved, along with an equalization of the weight per unit area.

By the free-flight section configured according to the invention, which spreads out the rank of filaments and by the production of an air cushion above the collection screen band, in which a spreading zone develops due to the sliding of the filaments and of the air streams accompanying them, a heretofore never achieved equalization of the fleece structure is achieved. This eliminates the known disadvantage that, on account of the natural narrowing of the filament ranks in the free-flight section, the desired size of the striking and covering area fails to be achieved. Irregularities of the fleece due to this cause are no longer to be feared.

Parallel to the impingement of the filaments or filament rank, the air streams carrying them are aspirated down through the moving screen. Under the screen a graded vacuum is produced and the downdraft intensity in the fleece-forming zone is graded such that the stream of air and filaments strikes the belt gently and the filaments flow on a cushion of air. By deflecting the filament-carrying air streams the latter are moved over the spreading zone until the air streams are finally aspirated down through the screen. Not until then does a fixing of the fibers in the sheet material take place.

It is important that the vacuum under the belt be graded. In the case of a vacuum in the range from 30 to 60 mm of water column, it is thus possible to establish a spreading zone of 100 to 200 mm extending over the width of the screen of 4 to 5 meters within which the fleece formation and the equalization of the weight per unit area can be established. The fiber orientation is determined substantially by this spreading section. The fiber sheet is transported away on the screen and fed to a consolidation unit. As an example of how the method is practiced, long spinnerets with the dimensions of 670 mm by 120 mm are installed in the rectangular openings in a heated spinning beam. This determines the spacing and the width of the filament rank in the spinning zone. The spinnerets have straight rows side by side, of up to 1200 holes. At a distance of 350 to 2000 mm below the spinning beam, a rectangular air jet is associated with each spinneret, and receives the rank of filaments after spinning. Depending on the type of polymer, a rectangular cooling shaft is disposed underneath the spinneret, from which the necessary cold air is fed for the cooling of the filaments. The air jet has on both of its inner sides air slots from which stretching or conditioning air can be discharged. With the aid of several rows of air streams emerging from linear air slots at different temperatures and air velocities, which attack the filament ranks on both sides at intervals and carry them on a parallel path to the screen, the filaments are drawn from the spinneret with a high uniformity. After leaving the air jets the ranks of filaments of the adjacent passages are finally laid down by oscillation to form a coherent fleece of great width.

It is important that the filaments, which are in great numbers, do not entangle with one another and also that they not be stirred up after they are laid down, to such an extent as to form strings and irregularities. For this reason provision is made such that the laying down of the filaments does not have any large-volume components which would distort the fleece structure, because then too many adjacent filaments would be carried by them and strings would result, but that only an equalization of the irregularities of weight is performed.

Table 1 contains the important parameters for the practice of the method. It also gives the operating conditions for the free-flight and spreading zones in the spinning of various polymers.

The wandering of the filaments in the spreading zone must not exceed a specific amount for a particular spinning speed. The structure of the spun bonded nonwoven fabric is basically different if the filaments at the moment of deposit have a tight loop structure or if they are permitted to describe bulky loops. A reduction of the wandering of the filaments to far-removed adjacent filaments reduces the formation of streaks and strings leading to flaws in the fleece. On the other hand, however, too little migration leads to poor adhesion of the filaments to one another and to thickening and thinning by the oscillation.

By the method of the invention, one achieves the desired optimum structure of the fleece, and it is to be noted that the spinning of, e.g., 25 meters of filament per second contrasts with a running speed of, for example, 2.5 meters per second of screen speed. The result is that the filaments can be laid down only in a looping structure which is very greatly affected by the fleece behavior on the screen and hence within the spreading zone.

Ordinarily, the spinning beam carrying the long spinnerets is set at an angle to the direction of movement of the receiving screen in order to bring a larger number of single filaments into the formation of the fleece. By this arrangement the number of spinning holes and filaments per meter of width of the receiving surface area is increased by 15 to 20%. Associated with each spinneret is a rectangular air jet with straight air slots arranged in pairs, which is disposed at an angle of 90° to the spinning beam. This results in a spinneret arrangement at an angle of 30 to 40° to the direction of movement of the screen. The distance between air jets is generally 150 to 400 mm and the distance of the air jets from the spinneret is generally 350 to 2000 mm. The air passages terminate 500 to 1200 mm above the screen. Underneath the air jets there is constructed a Coanda or air pulse oscillator which serves to swing the filament ranks back and forth after they leave the air passages and before they land on the screen. It is desirable to provide two parallel Coanda rolls with a diameter of, e.g., 50 mm and at a distance apart of 50 mm parallel to the air jet.

The spinning process and the movement of the spreading zone in the formation of fleece is represented in the drawing.

In FIG. 1, the Coanda rolls A and B are at the reversal point on the left. The right roll B plunges into the filament rank D within the free-flight zone F. This results in a rightward deflection of the filament rank D and flow in the spreading zone G past the point of impact E.

In FIG. 2, the Coanda rolls A and B are in the middle position on their way leftward. The filament rank D is moving vertically downward in the free-flight zone F. On its way from right to left it draws the spreading zone G behind it.

In FIG. 3, the left Coanda roll A plunges into the filament rank D within the free-flight zone F and produces a leftward deflection of the filement rank D, which draws the spreading zone G behind it.

In FIG. 4, the Coanda rolls A and B are at the right reversal point and cause a leftward deflection of the filament rank D. At this point the oscillating velocity (swinging velocity) is equal to zero for a brief time. In this null phase of the filament rank D the spreading zone G wanders farther leftward from the point of impact E and beyond and in this manner wipes out any theoretical pile-up of fibers. the same process is then repeated in the reverse sequence.

The two Coanda rolls can have a distance between them, for example, that amounts to more than 10 mm greater than the exit opening of the air jets C. In the case of air jet widths of 20 mm, the face to face distance between the Coanda rolls will be 30 mm. The fiber stream D runs through the parallel slot formed by the two Coanda rolls A and B. By a synchronous swing of the rolls to the right (FIG. 4) the left cylinder A plunges into the free stream F of the filament rank D and produces a leftward deflection of the filament rank. The deeper it plunges the greater is the deflection. The right roll at the same time moves away from the filament rank. Then the same process takes place in the reverse order (FIG. 1).

In the case of an air pulse oscillation, the Coanda rolls are replaced by an air slot which alternately displaces the filament rank leftward or rightward and thus produces a deflection of the filament rank.

Long spinnerets of the dimensions 670×120 mm, for example, are situated in a spinning beam which is disposed at an angle of 60° to the direction of movement of the screen. The spinnerets form an angle of 90° with the spinning beam, so that the angle $\alpha$ to the direction of movement of the screen H amounts to 30°. The arrangement of the spinnerets and the air jets (spacing and angle) is selected such that a uniform fiber curtain results theoretically in projection without oscillation.

The distance between the long spinnerets and the air jet is approximately 350 to 2000 mm. The stretching and cooling zone is formed in this area and is spanned by a cooling shaft. In this zone the filaments are stretched from, for example, 500 microns to as little as 12 microns in diameter, and they are cooled by blowing with conditioned air. The actual downward drawing is performed in the exhaust channel C by means of air slots disposed in pairs parallel to the filament rank. The air injected at high velocity accelerates the filament rank to 25 to 80 meters per second. At a distance of 50 mm from the air jet the oscillating means is installed, which deflects the filament rank from its original free-flight zone F and sets it in a swinging movement whose frequency is adapted to the velocity of the moving belt. The oscillating means consists of Coanda rolls or air pulse jets disposed in pairs parallel to the air jets.

The actual formation of fleece takes place in the fleece-forming zone of the screen, which is at a distance of 500 to 1200 mm from the end of the air jet. The screen consists of a circulating sieve fabric belt with a preferably open sieve surface whose openings amount to 20 to 30% of the total surface area of the screen. An exhaust apparatus is installed under the belt. The purpose of the exhaust apparatus is to aspirate the air in a proportioned manner from the fiber-air mixture blown downwardly out of the air jet and thus to complete the fleece-forming process. The spreading zone G is situated underneath the point of impact E which is moved back and forth by the swinging movement of the filaments. Thus the the spreading zone G is continuously moved back and forth at an angle $\alpha$ of 30° to 40° to the direction of movement of the screen H.

The length of the spreading zone G is established by the intensity of the aspiration beneath the screen H. The greater the suction, the more strongly are the filaments fixed in the position which they assume when they strike the screen. The weaker the aspiration the more strongly they can continue to move after contacting the screen and form larger loops. The danger of forming strands increases with the size of the loops formed by the filaments as they are laid down.

The spreading zone is thus an important part of the process and permits an optimum adjustment of the fleece structure by a correct balance between a direct fixation of the filaments after the free-flight zone F on the screen, which entails a consolidation, and minimal fixation with a thinning of the filaments, in which case, however, the formation of strings must be accepted. It has been found that, in the spinning of different polymers, a variation of the free-flight and spreading zone F must be performed in order to achieve a uniform spun bonded nonwoven fabric. The conditions of operation of the free-flight zone and spreading zone in the spinning of the different polymers is shown in Table 1.

TABLE 1

| | Polyamide | Polyester | Polypropylene |
|---|---|---|---|
| Distance between end of channel and the belt | 500–600 mm | 1200 mm | 600 mm |
| Distance between air jets | 180 mm | 400 mm | 180 mm |
| Spinning rate (fibers) | 30–40 m/sec | 80 m/sec | 25 m/sec |
| Velocity of downdraft at channel end | 70 m/sec | 170 m/sec | 40 m/sec |
| Frequency of oscillation | 5 cps | 9 cps | 12 cps |
| Wandering of spread zone on the screen | 350 mm | 1500 mm | 350 mm |
| Vacuum in layering zone | 30–60 mm, water col. | 30–60 mm water col. | 30–60 mm water col. |
| Belt velocity | 0.3–1 m/sec | 0.3–1 m/sec | 2.5–3 m/sec |
| aspirating air-velocity through screen | 7–9 m/sec | 15 m/sec | 6 m/sec |

It will be understood that the specification and examples are illustrative but not limitative of the present invention in that other embodiments within the spirit and scope of the invention will suggest themselves to those skilled in the art.

We claim:

1. A method for the production of a spun bonded nonwoven fabric having a uniform structure and weight per unit area comprising:

spinning a plurality of linear filament ranks, said ranks being disposed parallel to at least one adjacent rank;

stretching said ranks in an air jet;

oscillating the ranks to cause the ranks to move in a pendular motion below the air jet;

depositing the ranks on a screen such that they pass through a spreading zone which moves at an angle of 30 to 40° to the direction of the fleece movement while said ranks are deflected by 45° to 90° within said spreading section so as to cross one another while being deposited on said screen; and aspirating air through said screen by means of a graded vacuum to form an air cushion on which the filaments ranks glide within the spreading section while being deposited softly flowing on the screen.

2. The method of claim 1, wherein the ranks are spun through a plurality of spinnerets.

3. The method of claim 2, wherein the ranks are stretched in the airjet channel by one or more air streams.

4. The method of claim 3, wherein the pendular movement below the airjet channel results from deflecting the air stream by means of parallel, movable rollers.

5. The method of claim 4, wherein the aspiration of air through the screen is performed by means of a graded vacuum in the range of from 30 to 60 mm water column.

6. The method of claim 1, wherein the air is aspirated at a velocity of from 5 to 18 meters per second to form said air cushion.

7. The method of claim 1 performed at a spinning velocity (filament velocity) of 20 to 100 meters per second, a downdraft air velocity of 40 to 200 meters per second, and a free-flight section of the filaments or filament ranks of 500 to 1500 mm, while a spreading section is maintained which is 100 to 200 mm long and which wanders on the screen in the filament deflection area of a spinning line 100 to 1500 mm long.

8. The method of claim 6, performed at a spinning velocity (filament velocity) of 20 to 100 meters per second.

9. The method of claim 7, wherein the downdraft air velocity is 40 to 200 meters per second.

10. The method of claim 8, wherein the downdraft air velocity is 40 to 200 meters per second.

11. The method of claim 9, wherein a free-flight section of the filament ranks of 500 to 1500 mm is maintained.

12. The method of claim 10, wherein a free-flight section of the filament ranks of 500 to 1500 mm is maintained.

13. The method of claim 11, wherein the spreading section is maintained which is 100 to 200 mm long and which wanders on the screen (H) in the filament deflection area of a spinning line 100 to 1500 mm long.

14. The method of claim 12, wherein the spreading section is maintained which is 100 to 200 mm long and which wanders on the screen (H) in the filament deflection area of a spinning line 100 to 1500 mm long.

* * * * *

UNITED STATES PATENT AND TRADEMARK OFFICE

CERTIFICATE OF CORRECTION

PATENT NO. : 4,753,698

DATED : June 28, 1988

INVENTOR(S) : Ludwig Hartmann et al

It is certified that error appears in the above-identified patent and that said Letters Patent is hereby corrected as shown below:

Column 1, line 13, delete "downdraft"

Column 1, line 64, delete "channel"

Column 2, line 56, delete "passages"

Column 3, line 56, delete "band"

Column 5, lines 19 and 23, change "passages" to read --jets--

Column 5, line 53, change "the" to read --The--

Column 6, line 44, "the" (second occurrence)
should read --too--

Column 8, lines 6 and 9, delete "channel".

Signed and Sealed this

Eighth Day of May, 1990

*Attest:*

HARRY F. MANBECK, JR.

*Attesting Officer*

*Commissioner of Patents and Trademarks*